US006122533A

United States Patent [19]

Zhang et al.

[11] Patent Number: 6,122,533

[45] Date of Patent: Sep. 19, 2000

[54] SUPERCONDUCTIVE PLANAR RADIO FREQUENCY FILTER HAVING RESONATORS WITH FOLDED LEGS

[75] Inventors: Zhihang Zhang, Westminster; Attila Weiser, Jr.; Jonathan Raymond Scupin, both of Boulder; Linda D'Evelyn, Eldorado Springs, all of Colo.

[73] Assignee: Spectral Solutions, Inc., Louisville, Colo.

[21] Appl. No.: 08/883,800

[22] Filed: Jun. 27, 1997

Related U.S. Application Data

[60] Provisional application No. 60/020,863, Jun. 28, 1996.

[51] Int. Cl.[7] ..... H01P 1/203; H01B 12/02

[52] U.S. Cl. ..... 505/210; 505/700; 505/701; 505/866; 333/99.005; 333/204; 333/219

[58] Field of Search ..... 333/995, 204, 333/205, 219; 505/210, 700, 701, 866

[56] References Cited

U.S. PATENT DOCUMENTS

| | | | |
|---|---|---|---|
| 4,264,881 | 4/1981 | De Ronde | 333/110 |
| 4,455,540 | 6/1984 | Henriot et al. | 333/202 |
| 5,055,809 | 10/1991 | Sagawa et al. | 333/219 |
| 5,192,927 | 3/1993 | Lin | 333/204 |
| 5,512,539 | 4/1996 | Matsuura et al. | 333/219 |
| 5,770,987 | 6/1998 | Henderson | 333/204 |

FOREIGN PATENT DOCUMENTS

| | | | |
|---|---|---|---|
| 1298817 | 3/1987 | U.S.S.R. | 333/204 |

OTHER PUBLICATIONS

Yabuki et al., "Hairpin–Shaped Stripline Split–Ring Resonators and Their Applications," *Denshi Joho Tsushin Gkkai Ronbunshi*, vol. 75–C–I, No. 11, pp. 711–720 (Nov. 1992).

Hong et al., "Couplings of Microstrip Square Open–Loop Resonators for Cross–Coupled Planar Microwave Filters," *IEEE Transactions on Microwave Theory and Techniques*, vol. 44, No. 12, pp. 2099–2108 (Dec. 1996).

Sagawa et al., "Miniaturized Hairpin Resonator Filters and Their Application to Receiver Front–End MCI's," *IEEE Transactions on Microwave Theory and Techniques*, vol. 37, No. 12, pp. 1991–1997 (Dec. 1989).

Takahashi et al., "Miniaturized Hair–Pin Resonator Filters and Their Applications to Receiver Front–End MICS," *IEEE Transactions on Microwave Theory and Techniques*, pp. 667–670 (1989).

Matthaei et al., "Narrow–Band Hairpin–Comb Filters for HTS and Other Applications," *IEEE Transactions on Microwave Theory and Techniques*, pp. 457–460 (1996).

Pramanick, P., "Compact 900–Mhz Hairpin–Line Filters Using High Dielectric Constant Microstrip Line," *International Journal of Microwave and Millimeter–Wave Computer–Aided Engineering*, vol. 4, No. 3, pp. 272–281 (1994).

D'Evelyn, L., "Distributed Filters Serve Integrated Subsystem Designs," *Microwaves & RF*, pp. 147–160 (May 1991).

*Primary Examiner*—Benny T. Lee
*Attorney, Agent, or Firm*—Sheridan Ross P.C.

[57] ABSTRACT

A planar filter for performing signal filtering at radio frequencies is provided. The planar filter can include asymmetrical resonators, wherein each resonator is asymmetrical about a longitudinal center axis through the resonator. In addition, the resonators can be grouped in coupled pairs such that the resonators in each coupled pair are asymmetrical about a longitudinal center axis between the paired resonators. In addition, a coupling structure is provided that includes both distributed coupling and tapped coupling to a resonator. Further, a bandstop filter device is provided that includes coupling between resonators in the filter.

36 Claims, 6 Drawing Sheets

FIG. 1A
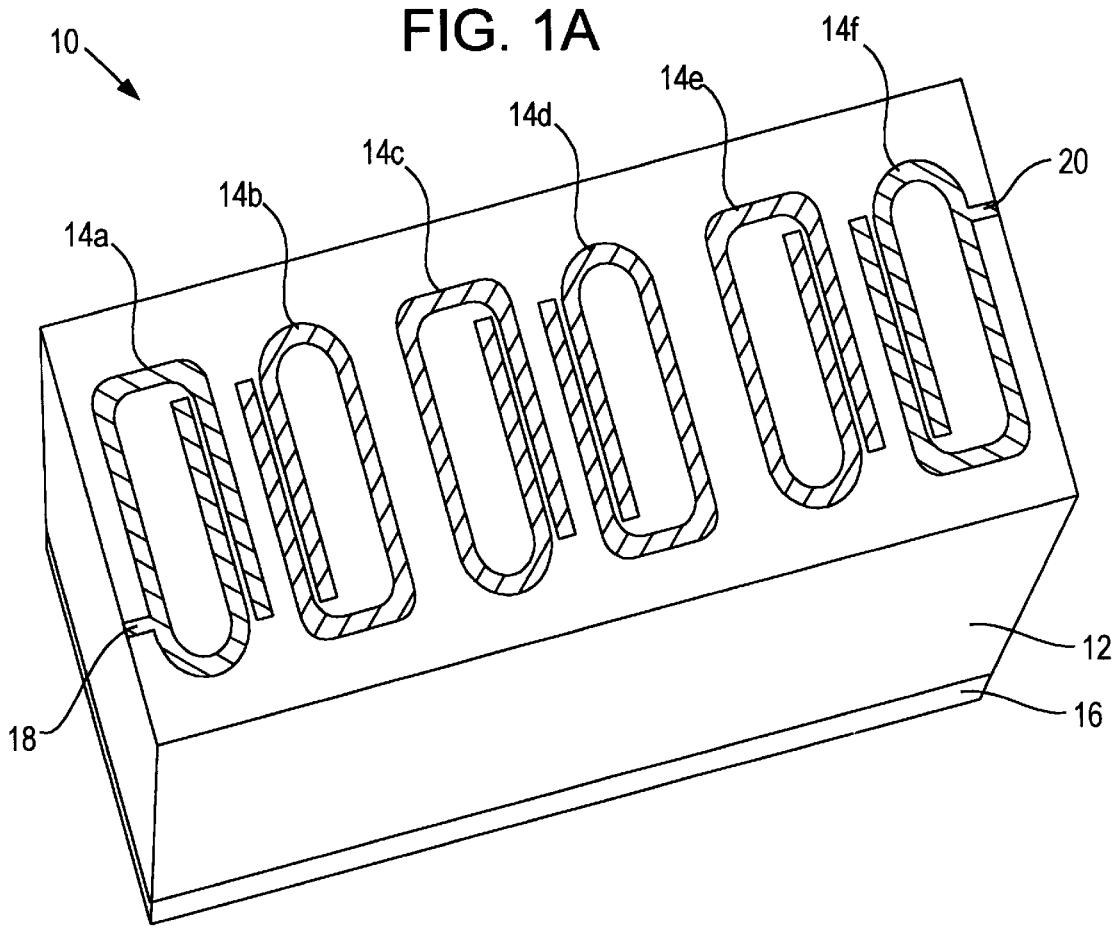
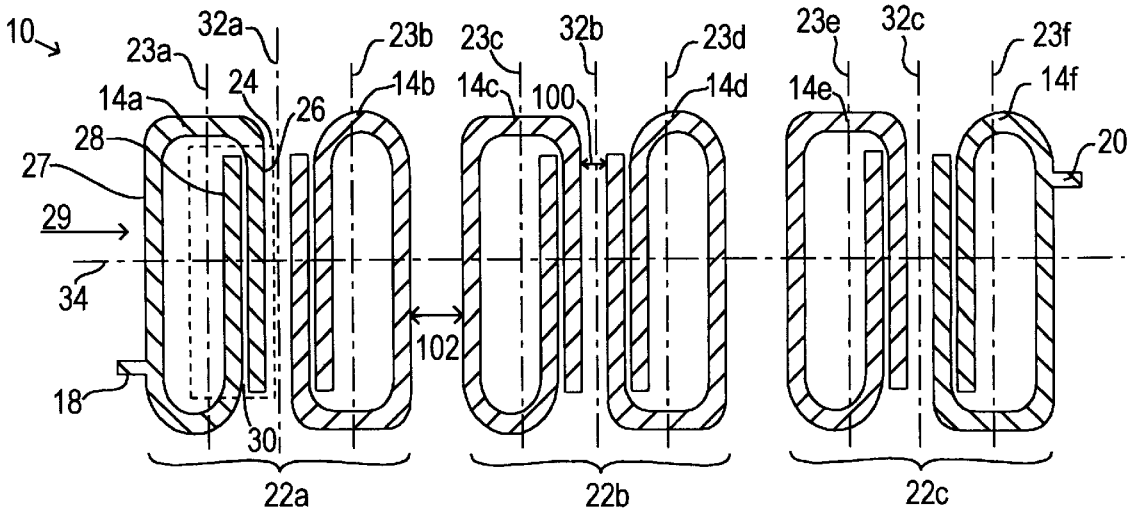
FIG. 1B

SUPERCONDUCTIVE PLANAR RADIO FREQUENCY FILTER HAVING RESONATORS WITH FOLDED LEGS

This application claims the benefit under 35 U.S.C. § 119(e) of U.S. Provisional Application No. 60/020,863, filed Jun. 28, 1996.

FIELD OF THE INVENTION

The invention relates in general to radio frequency filter structures and, more particularly, to radio frequency filter structures having a planar configuration.

BACKGROUND OF THE INVENTION

A planar filter is a radio frequency filtration device having all of its circuitry residing within a relatively thin plane. To achieve this, planar filters are generally implemented using flat transmission line structures such as microstrip and stripline transmission lines. These transmission line structures normally include a relatively thin, flat conductor separated from a ground plane by a dielectric layer. Planar filters have been of interest in recent years because of their relatively small size, low cost and ease of manufacture.

Planar filters can be comprised of one or more resonator elements. A resonator element is a transmission line configuration that is known to "resonate" at a certain center frequency. In general, a plurality of these resonator elements are arranged to achieve a desired filter response. For example, the resonators can be arranged so that only a predetermined range of frequencies (and harmonics of such) are allowed to pass through the filter from an input port to an output port. This type of filter is known as a "bandpass" filter and the predetermined range of frequencies is known as the pass band of the filter. In another arrangement, the resonators can be configured so that all frequencies are allowed to pass from an input port to an output port except for a predetermined range of frequencies (and harmonics of such). This type of filter is known as a "bandstop" filter and the predetermined range of frequencies is known as the stop band of the filter.

Planar filters, as well as the other filter types, have a number of important performance criteria. For example, it is generally desirable that a bandpass filter display very low insertion loss in the pass band of the filter. Outside of the pass band, however, high rejection is desirable. Conversely, a bandstop filter requires relatively little loss outside of the stop band and a high amount of rejection within the stop band.

In many applications, both bandpass and bandstop filters require a relatively sharp cutoff at the band edges. That is, the transition from a low loss condition to a high loss condition should take place over a relatively narrow range of frequencies. Sharp cutoff is required, for example, in applications where a relatively large number of frequency bands exist within a given frequency range, to separate out the individual bands. The sharpness of the filter response cutoff depends upon such things as, for example, the quality factor of the filter (i.e., the Q factor), the number and type of resonators that are being used in the filter, the materials used in the filter, and the arrangement of the resonators in the filter.

Some applications now require filter structures that are very small in size. For example, a mobile handset in a cellular or PCS communications system requires a filter for preselection of a predetermined operational frequency range. Because the size of these handsets is constantly being reduced, the area that can be dedicated to filter units is correspondingly being reduced. In addition, as increased functionality is being added to these handsets, the space available for filters is further reduced. Another application requiring small sized filters is monolithic microwave integrated circuits (MMICs). MMICs generally comprise full microwave subsystems, such as a multichannel microwave receiver, disposed within a single small package. As is apparent, large, bulky filters could not be used in such systems.

A third application requiring small sized filters is tower-mounted receiver front ends used in wireless base stations. The close proximity of the receiver front end to the antenna minimizes the noise figure of the microwave signal receiving system. For this application, the filters must be located in a temperature-controlled enclosure to shield them from ambient weather conditions. By utilizing small sized planar filters, rather than conventional cavity filters, the cost of maintaining this enclosure, as well as potentially deleterious effects of wind loading are reduced.

SUMMARY OF THE INVENTION

It is an object of the present invention to provide a planar filter structure having a reduced size.

It is another object of the present invention is to provide a planar filter structure having a relatively high Q value.

It is yet another object of the present invention to provide a planar filter structure having relatively sharp cutoff at the band edges.

It is still another object of the present invention to provide all of the above advantages within a single filter unit that is relatively inexpensive to produce.

The present invention relates to structures for providing bandpass and/or bandreject filter responses in radio frequency systems. The structures provide desired filter responses while occupying a relatively small amount of real estate on an underlying substrate. In this regard, the filter structures of the present invention are valuable in applications having a limited amount of available space. In addition, the filter structures are relatively easy and inexpensive to manufacture. The inventive structures can be implemented in a variety of different transmission line types including, for example, microstrip transmission line, stripline transmission line, and suspended substrate transmission line.

In one aspect of the present invention, a planar filter is provided having a plurality of resonator elements. Lines are provided for coupling energy into and out of the filter. In accordance with the invention, at least one of the input and output structures uses both distributed line coupling and tapped coupling to perform the desired coupling function. In a related aspect of the invention, the coupling type used at the input of the filter is different from that used at the output of the filter. That is, for example, distributed coupling is used at the input while tapped coupling is used at the output. Alternatively, one of the input or the output can include both distributed and tapped coupling while the other includes just one type of coupling.

In another aspect of the present invention, a planar bandpass filter is provided that includes a plurality of resonating elements arranged in an approximately linear fashion. Each pair of adjacent resonating elements includes a longitudinal center axis therebetween. An odd number of the pairs include elements that are asymmetrical about the corresponding longitudinal center axis. It has been discovered that utilizing an odd number of asymmetrical pairs improves the rejection characteristics of the filter for a given number of resonating elements. In one embodiment, the resonators include novel "paper clip" resonators having a plurality of substantially parallel legs that are interconnected by folds.

In another aspect of the present invention, a planar bandstop filter is provided that comprises a plurality of resonating elements, wherein at least two of the resonating elements are directly coupled to one another. In one embodiment, a first side of a first resonator is coupled to a second resonator and a second side of the first resonator is coupled to a third resonator. The coupling to the second resonator is stronger than the coupling to the third resonator.

In another aspect of the present invention, a planar bandstop filter is provided that includes a plurality of resonating elements coupled to a through line, wherein a first of the resonating elements is directly coupled to a second of the resonating elements. The through line connects the input of the filter to the output of the filter. The coupling between the first and second resonating elements is adapted to improve the rejection characteristics of the filter. In one embodiment of the invention, anisotropic coupling between resonators is achieved by utilizing resonators having a distributed capacitance between opposite ends of a conductor. To achieve a decreased amount of coupling between a first resonator and a second resonator, for a given distance between the resonators, a side of the first resonator that includes the distributed capacitance faces the second resonator. To achieve reduced coupling between a first and a third resonator, a meandering line is introduced into the side of the first resonator that faces the third resonator. The meandering line increases the effective distance between the first resonator and the second resonator (and hence decrease the coupling) while the actual distance between the resonators remains the same.

In yet another aspect of the present invention, a planar filter is provided that includes a resonator having a first, second, and third leg that are all substantially parallel to one another. The third leg is located between outer edges of the first and second leg. The first and second leg are connected by a first fold while the second and third legs are connected by a second fold. The "fold" can include, for example, a bend in the transmission line conductor. The resonator is asymmetrical about a first longitudinal center axis. The third leg can be spaced from the first leg so as to create a distributed capacitance between the legs. This distributed capacitance allows the overall dimensions of the resonator to be reduced. The resonator can also include a fourth leg that is spaced from the second leg to create a distributed capacitance therewith.

In still another aspect of the present invention, a planar filter is provided that includes a first resonator element and a second resonator element. The first resonator element includes a first conductor with a first portion at a first end and a second portion at a second end. The conductor has a bend so that the first portion is opposite the second portion over at least a fraction of its length. The second element includes a third portion that is located between the first portion and the second portion of the first resonator element. In one embodiment, a dual element hairpin resonator is provided that includes two hairpin shaped resonators having their fingers interdigitally arranged.

In all aspects of the present invention, the resonators and other structures can be made out of superconducting materials to increase the Q value of the filters and reduce radiation from the resonators.

BRIEF DESCRIPTION OF THE DRAWINGS

FIG. 1*a* is an isometric view of a six pole bandpass filter in accordance with the present invention;

FIG. 1*b* is a top view of the metallization pattern for the filter of FIG. 1*a* illustrating a plurality of three leg "paper clip" resonators;

DETAILED DESCRIPTION OF THE PREFERRED EMBODIMENT

Figure 2A:
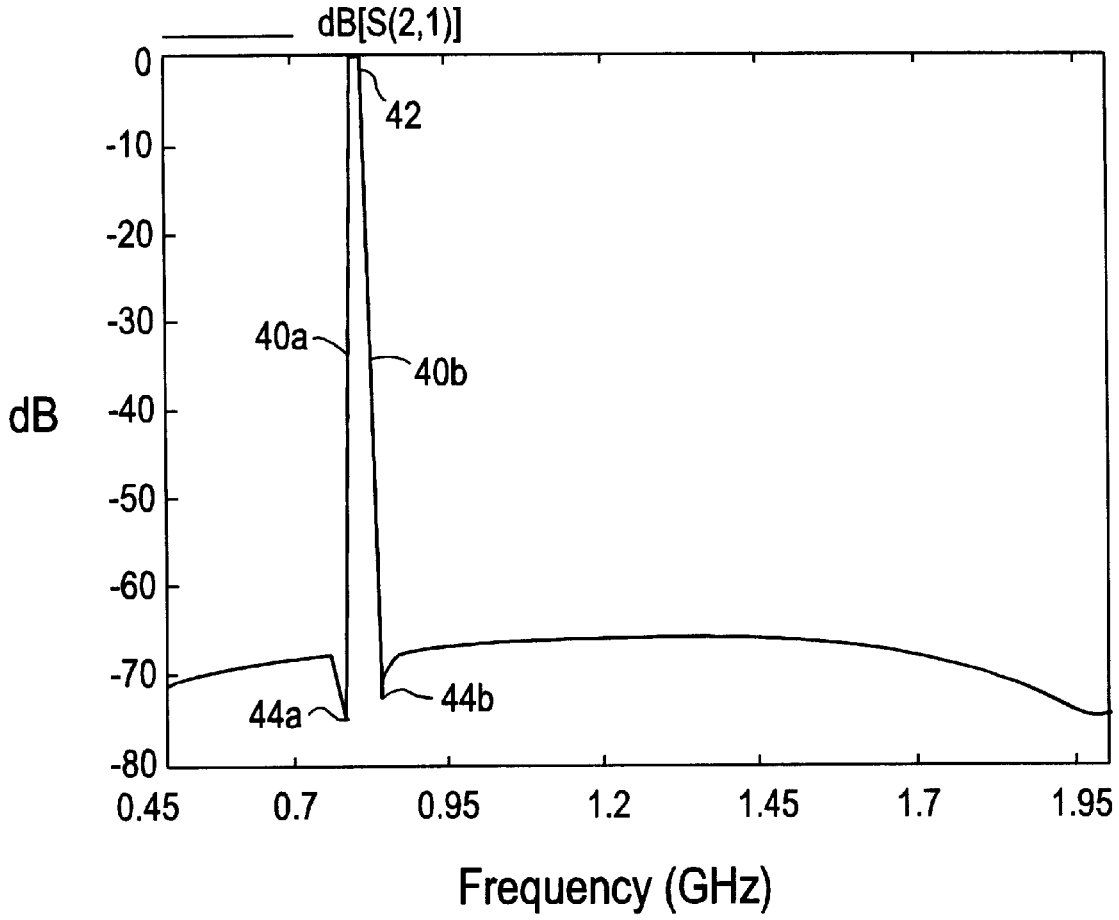
FIG. 2*a* is a computer simulated graph showing a predicted response of the filter of FIGS. 1*a* and 1*b;*

The present invention relates to structures for providing bandpass and/or bandreject filter responses in radio frequency systems. The structures provide desired filter responses while occupying a relatively small amount of real estate on an underlying substrate. In this regard, the filter structures of the present invention are valuable in applications having a limited amount of available space. In addition, the filter structures are relatively easy and inexpensive to manufacture. The inventive structures can be implemented in a variety of different transmission line types including, for example, microstrip transmission line, stripline transmission line, and suspended substrate transmission line. It should be appreciated that the term "radio frequency", as used herein, is meant to apply to all portions of the electromagnetic spectrum that are capable of propagation on the transmission structures disclosed herein, including, for example, high frequency (HF), very high frequency (VHF), microwaves, millimeter waves, and submillimeterwaves.

FIG. 1*a* illustrates a six pole microstrip bandpass filter 10 in accordance with one embodiment of the present invention. The bandpass filter of FIG. 1*a* was originally disclosed in provisional U.S. patent application Ser. No. 60/020,863 entitled "ASYMMETRIC MICROWAVE RESONATING DEVICE" which is incorporated herein by reference. As illustrated, the filter 10 includes a planar substrate material 12, a ground plane 16 underlying the substrate 12, a plurality of resonator elements 14*a,* 14*b,* 14*c,* 14*d,* 14*e,* 14*f* an input line 18, and an output line 20. In operation, an electromagnetic signal is delivered to input line 18 from an external source after which it is acted upon by the resonators 14*a*–14*f*. The resonators 14*a*–14*f* allow certain frequencies in the electromagnetic input signal to couple through from the input line 18 to the output line 20, while other frequencies are rejected (i.e., reflected back out through input line 18).

FIG. 1*b* is a top view of the metallization pattern deposited on the top surface of substrate 12 showing the general configuration of the resonators 14*a*–14*f*. The resonators 14*a,* 14*b,* 14*c,* 14*d,* 14*e,* 14*f* each include a single continuous transmission line conductor formed into a shape resembling that of a paper clip, and hence are called "paper clip." resonators. The paper clip resonators illustrated in FIG. 1*b* each have three parallel legs that are connected by folds at the ends of the resonator. The electrical length of each resonator is approximately equal to one-half of a guide wavelength (i.e., $\lambda g/2$) at the center frequency of the resonator. As illustrated in FIG. 1*b,* each resonator 14*a*–14*f* includes a portion 24 wherein a first leg 26 at a first end of the conductor is spaced from a third leg 28 at a second end of the conductor by a relatively narrow gap 30. The dimensions of the gap 30 are chosen so that a desired distributed capacitance exists between the ends 26, 28 of the conductor. In a typical embodiment, the width of the gap 30 is between 0.1 and 10 mils. Because of the presence of an additional capacitance in the resonator, the size of the resonator can be reduced while maintaining a desired resonating frequency.

The spacing between successive resonators is determined based upon a coupling required to achieve a desired filter response. If the resonators are placed too closely to one another, the resonators will be too tightly coupled, resulting in an undesired shift or spread in the resonance characteristic of the filter. In one embodiment of the invention, a Chebyshev-type filter response is achieved.

As illustrated in FIG. 1*b,* the resonators 14*a*–14*f* are each asymmetrical about a corresponding longitudinal center axis 23*a,* 23*b,* 23*c,* 23*d,* 23*e*. The longitudinal center axes 23*a*–23*f* are substantially perpendicular to the direction 29 of energy flow through the filter. In addition to the elemental asymmetry, the resonators 14*a*–14*f* are also arranged into coupled pairs 22*a,* 22*b,* 22*c* that are each asymmetrically arranged about a corresponding central axis 32*a,* 32*b,* 32*c* extending longitudinally between the resonators. Because the arrangement between each pair 22*a*–22*c* is asymmetrical, the coupling between the resonators within each pair is reduced, thereby allowing the resonators within each pair to be spaced more closely together. This decreased spacing between the resonators in each pair reduces the overall dimensions of the filter 10.

In conceiving of the present invention, it has been determined that an optimal filter response is achieved when the number of "flips" within the chain of resonators is odd. A "flip" is defined as a double rotation of a resonator about two axes of rotation. For example, the positioning of resonator 14*b* in FIG. 1*b* can be obtained by rotating resonator 14*a* once about longitudinal center axis 32*a* and once about latitudinal axis 34. The positioning of resonator 14*c* can be obtained by a similar double rotation of resonator 14*b* and so on. In accordance with the present invention, the latitudinal axis 34 does not have to be centered on the element. As described above, in a preferred embodiment of the present invention, the number of flips is odd. It has been discovered that use of an odd number of flips and a tapped input and/or output produces zeros in the transfer function of the filter that occur at the band edges of the filter response resulting in sharper cutoffs at the band edges than are normally obtainable.

Input 18 and output 20 are each located on either side of and substantially equidistant from the latitudinal center axis 34. As illustrated, the input 18 and the output 20 each comprise a conductively coupled tap on a corresponding resonator element 14*a,* 14*f*. The position of the tap on the resonator depends on the desired freqency, bandwidth, ripple, filter order, and the width of the resonator line.

The width of the conductor forming each resonator 14*a*–14*f* preferably produces a line impedance ranging from about 10 to about 80 ohms. As discussed above, the distance between the first leg 26 and the third leg 28 is typically from about 0.1 mil to about 10 mils. The distance between a second leg 27 and the third leg 28 is typically from about 1 to about 5 line widths. The distance 100 between adjacent resonators in a given pair typically ranges from about 1 to about 250 mils. The distance 102 between adjacent pairs typically ranges from about 2 to about 400 mils.

The various components of the filter of FIGS. 1*a* and 1*b* can have a variety of compositions in accordance with the present invention. The resonator conductors and ground plane can be composed of a variety of conducting and superconducting materials, including (a) nonsuperconducting metals, such as gold, copper, and silver, and (b) high temperature superconductors, such as yttrium barium copper oxide (YCBO) and thallium barium calcium copper oxide (TBCCO). Use of superconducting materials is advantageous because they reduce metallization losses in the filters, thus enabling higher Q values to be observed in the filters. This means the filters have lower insertion loss in the passband and sharper out-of-band attenuation. The dielectric substrate can be composed of any dielectric material, such as air, alumina, quartz, sapphire, lanthanum aluminate (LAO), magnesium oxide (MgO), polytetrafluorethylene (PTFE) sold under the trademark TEFLON, and PTFE-based board materials such as those sold by Rogers Corporation under the trademark DUROID, gallium arsenide (GaAs), and other common circuit board materials an epoxy fiberglass laminate sold under the designation "FR4/G10".

FIG. 2*a* is a computer simulated response characteristic for the filter illustrated in FIGS. 1*a* and 1*b*. As shown, the simulated filter response has a very low loss 42 in the passband and very sharp cutoffs 40*a,* 40*b* at the edges of the passband. In addition, the response is relatively symmetric about a center frequency. The sharp cutoffs 40*a,* 40*b* are the result of zeros in the transfer function of the filter that are created due to tapping and having an odd number of "flips" between the resonators. The zeros are evident in the simulated response as the depressions 44*a* and 44*b* in the skirt of the graph of FIG. 2*a*.

Figure 2B:
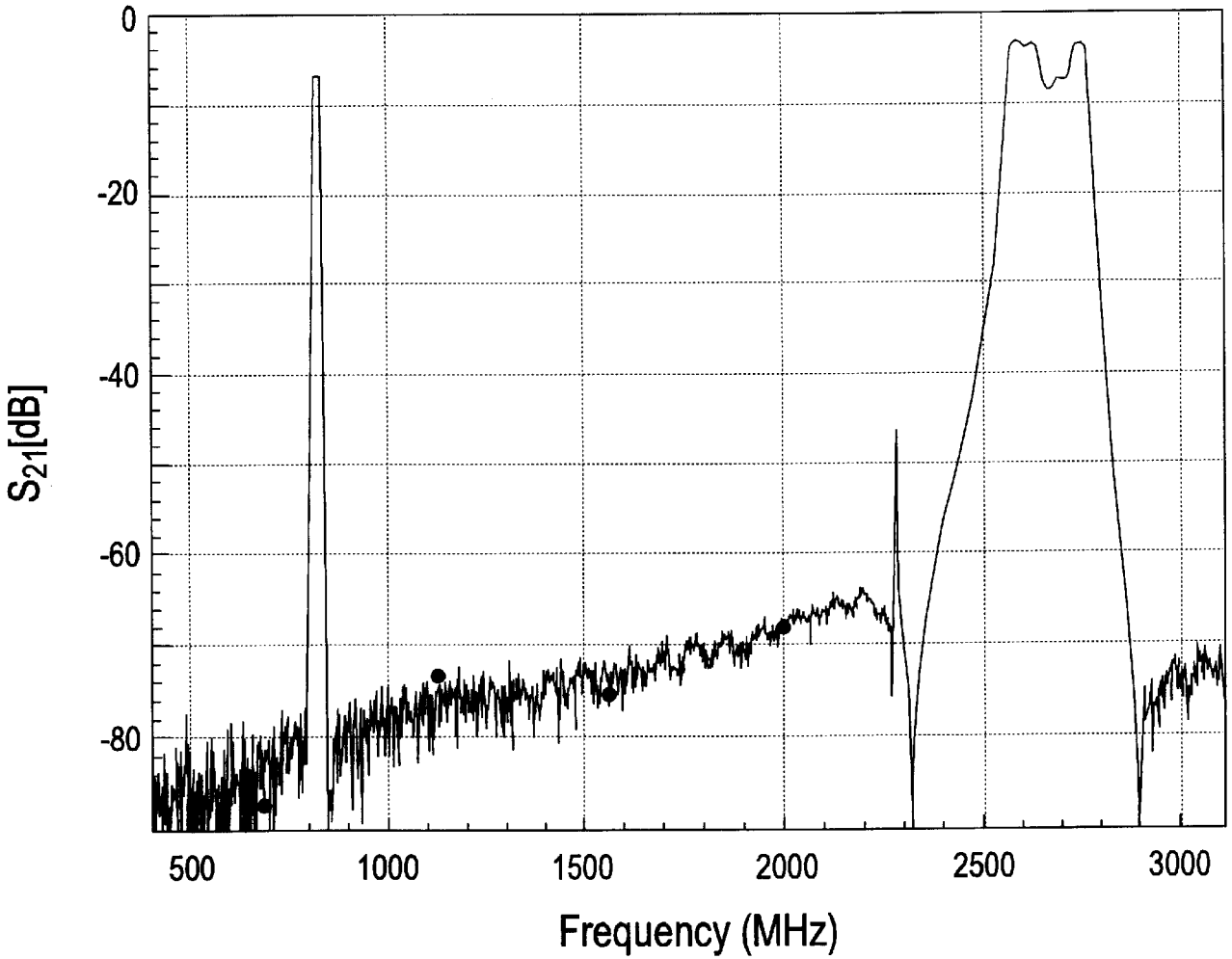
FIGS. 2*b* is a graph illustrating a measured response (uncalibrated) of the filter of FIGS. 1*a* and 1*b* showing the lack of even-ordered harmonics in the filter response.

FIG. 2*b* is a graph showing the measured response of the filter (uncalibrated) over a large frequency range. As shown, rejection is very high at the even ordered harmonics (i.e., >70 dB). In addition, parasitics are substantially suppressed in the vicinity of the passband. In addition, calibrated measurements of insertion loss in the passband indicate that the loss is below 0.3 dB.

Figure 3:
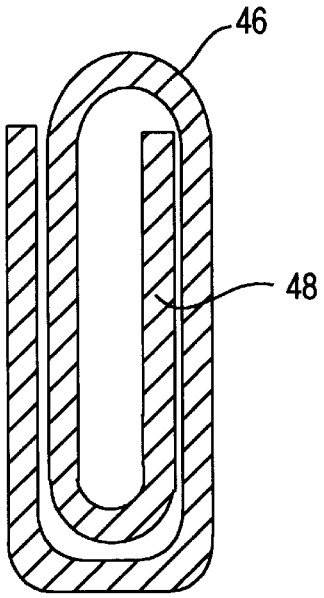
FIG. 3 is a top view of the metallization pattern of a four leg "paper clip" resonator in accordance with the present invention.

The design principles used to reduce circuit dimensions in the filter of FIGS. 1*a* and 1*b* are not limited to the use of the "paper clip" resonator structure disclosed therein. In fact, any resonator design that is asymmetrical about a longitudinal center axis through the element can be used in accordance with the present invention. For example, the element 46 of FIG. 3 can be used in the filter of FIGS. 1*a* and 1*b*. Resonator 46 is similar to the "paper clip" resonators 14*a*–14*f* of FIGS. 1*a* and 1*b*, but includes a fourth leg 48 that provides further distributed capacitance in the resonator 46. This additional distributed capacitance allows the overall dimensions of resonator 46 to be further reduced while still achieving a desired resonant frequency.

Figure 4:
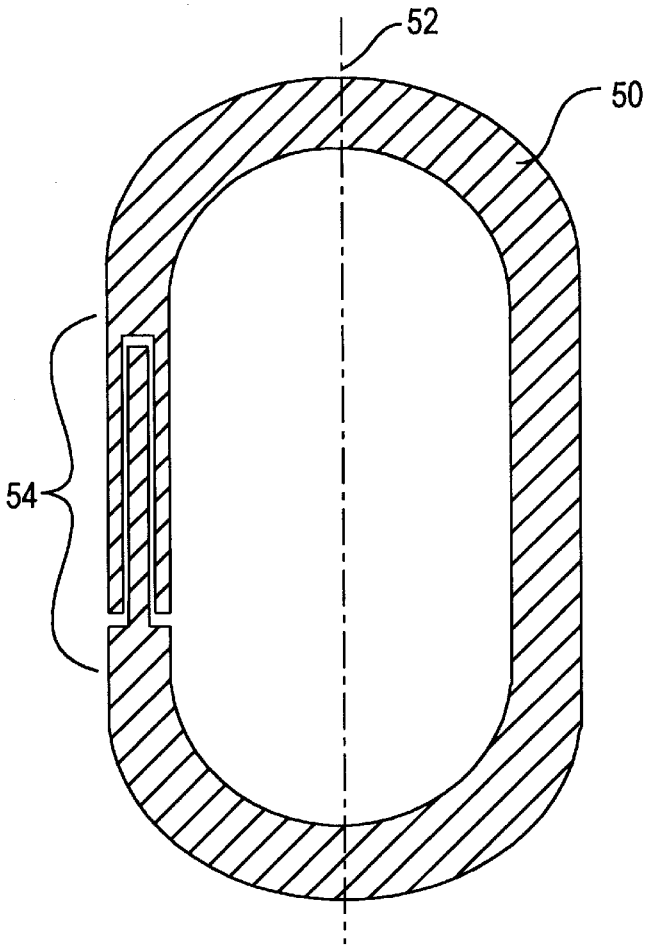
FIG. 4 is a top view of the metallization pattern of a resonator having an interdigital coupling structure in accordance with the present invention.

FIG. 4 illustrates another resonator design that can be used in the filter of FIGS. 1*a* and 1*b*. Resonator 50 is asymmetrical about a longitudinal center axis 52 passing through the resonator. On one side of the resonator 50, an interdigital coupling structure 54 is provided for creating the required distributed capacitance. It should be appreciated that the resonator embodiment illustrated in FIG. 4 can include any number of interdigital fingers in coupling structure 54 and is not limited to the illustrated number (i.e., 3).

Figure 5:
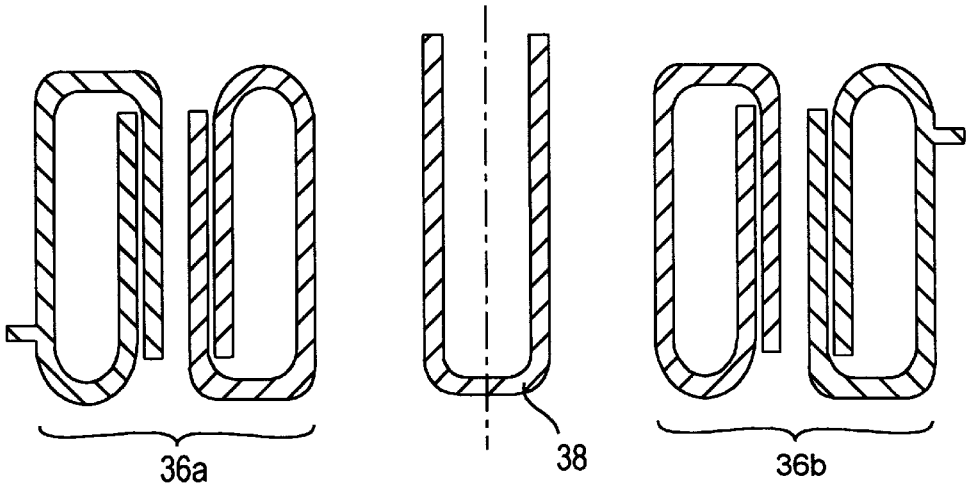
FIG. 5 is a top view of the metallization pattern of a five pole filter having two coupled resonator pairs and a single symmetric resonator in accordance with the present invention.

FIG. 5 is the top view of the metallization pattern for a five pole bandpass filter in accordance with the present invention. As illustrated, the filter of FIG. 5 includes two pair 36*a*, 36*b* of asymmetrical resonator elements on either side of a single symmetrical resonator element 38 having a "hairpin" shape. By using a symmetrical resonator element 38 in conjunction with the asymmetrical coupled pairs 36*a*, 36*b*, a bandpass filter having an odd number of poles is achievable. In fact, any combination of symmetrical resonator elements and asymmetrical pairs is possible in accordance with the present invention.

Figure 6:
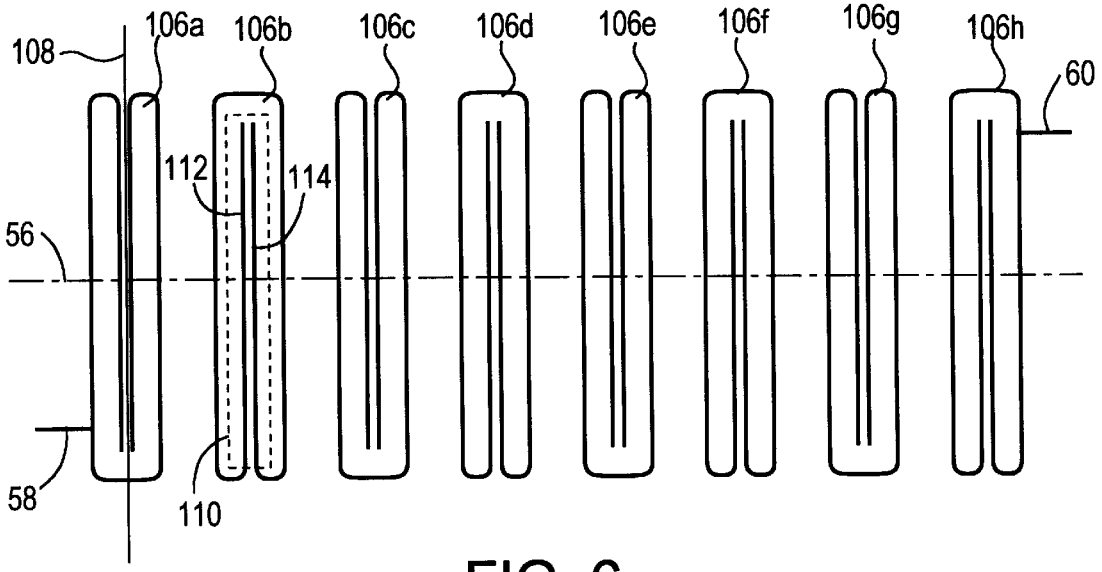
FIG. 6 is a top view of the metallization pattern of an eight pole band pass filter using "pinched end" resonators and having tapped input and output lines in accordance with the present invention.

FIG. 6 illustrates the metallization pattern for an eight pole filter in accordance with the present invention. The filter of FIG. 6 utilizes "pinched end" resonators 106*a*, 106*b*, 106*c*, 106*d*, 106*e*, 106*f*, 106*g*, 106*h* that are each symmetrical about a corresponding longitudinal center axis 108. The resonators 106*a*, 106*b*, 106*c*, 106*d*, 106*e*, 106*f*, 106*g*, 106*h* are also aligned with one another about a common center line 56. Each "pinched end" resonator 106*a*–106*h* includes a central portion 110 wherein a first end portion 112 of a conductor is spaced from a second end portion 114 of the conductor to form a distributed capacitance therebetween. As discussed previously, this distributed capacitance results in smaller resonators 106*a*–106*h* for a given resonant frequency. When constructed from superconducting materials, the "pinched end" resonators display high-Q values with very little radiation loss, despite the fact that each resonator has six 90 degree bends. For example, unloaded Q values of 25,000 and above have been achieved. It is believed that the high conductivity of the superconducting material insures that fields are "contained" within the dielectric substrate material, which minimizes radiation at the bends. Similarly, the distributed capacitance between the first end portion 112 and the second end portion 114 of the conductor further contains the fields and reduces radiation. A typical distributed capacitance in accordance with the invention is approximately 2 picofarads.

As shown, each successive resonator in the filter is "flipped" with respect to the previous resonator and the total number of "flips" is odd. The filter of FIG. 6 includes tapped input and output lines 58, 60 similar to those in the filter of FIGS. 1*a* and 1*b*. One important benefit of using tapped input/output lines is improved near out band rejection by introducing attenuation zeros.

Figure 7:
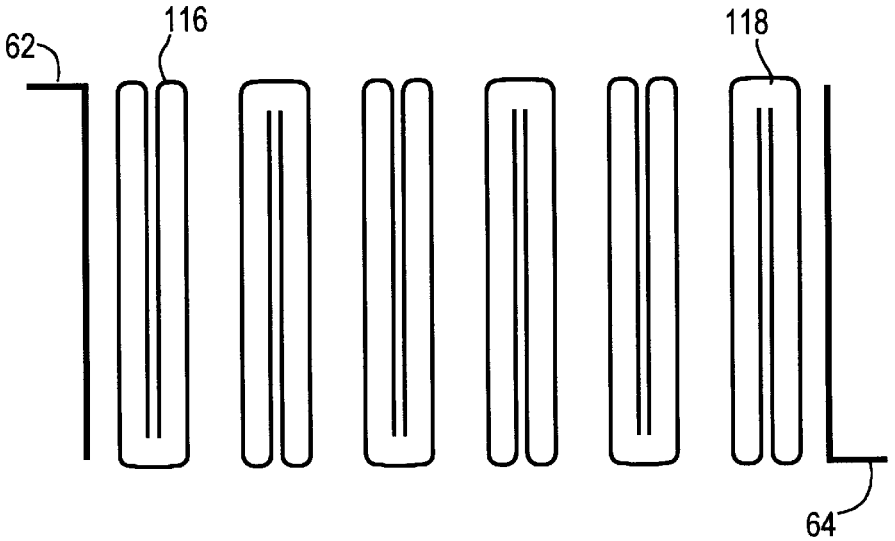
FIG. 7 is a top view of the metallization pattern of a six pole bandpass filter using "pinched end" resonators and having input and output lines utilizing distributed coupling in accordance with the present invention.
Figure 8:
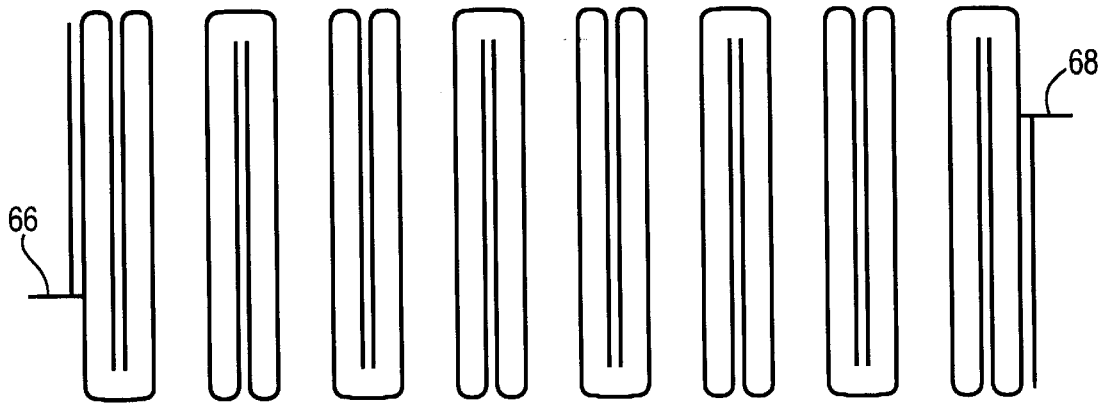
FIG. 8 is a top view of the metallization pattern of an eight pole bandpass filter using "pinched end" resonators and having input and output lines utilizing both tapped and distributed coupling in accordance with the present invention.

FIG. 7 illustrates a six pole bandpass filter having "pinched end" resonators that utilize input and output lines 62, 64 that are coupled to an input resonator 116 and an output resonator 118, respectively, using distributed coupling. One important benefit of using distributed coupling in the input and/or output is the ability to optimaize the return loss by perturbing the input/output couplings to the resonator. In conceiving of the present invention, it was determined that enhanced performance could be achieved by combining tapped coupling and distributed coupling in the input and/or output structures. That is, dual coupling arrangements provide benefits associated with both coupling methods. FIG. 8 illustrates an eight pole bandpass filter that includes both distributed and tapped coupling on both an input 66 and an output 68. It should be appreciated that, in accordance with the present invention, the type of coupling used at the input of a filter can be different from the type used at the output of the filter. For example, the input may use distributed coupling, while the output uses tapped coupling. Also, the input can use a dual coupling arrangement, while the output uses a single coupling type.

Figure 9:
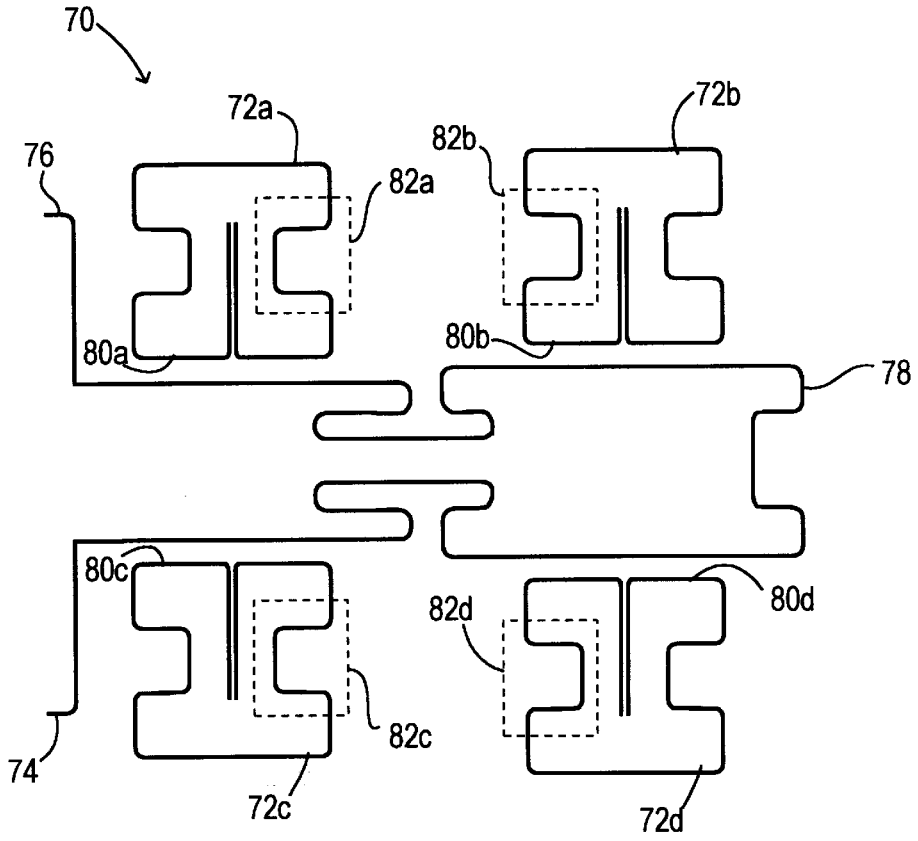
FIG. 9 is a top view of the metallization pattern of a four pole bandstop filter utilizing coupled "pinched end" resonators in accordance with the present invention.

FIG. 9 illustrates a four pole bandstop filter 70 in accordance with the present invention. The filter 70 includes four "pinched end" resonators 72*a*, 72*b*, 72*c*, 72*d* each coupled to a meandering through line 78. The filter 70 also includes an input port 74 and an output port 76 for coupling energy into and out of the meandering through line 78. During operation, a radio frequency signal is applied to the input port 74 of the filter from an exterior source and begins to propagate along the meandering through line 78. As the radio frequency signal passes one of the resonators, undesired frequency components in the signal are drawn out of the signal by the resonating action of the resonator.

By utilizing multiple identical resonators, the filter 70 can achieve a bandpass characteristic having relatively sharp cutoffs at the band edges. In addition, in conceiving of the present invention, it was determined that further sharpening of the cutoffs could be achieved by introducing coupling between the resonators of the filter. For example, in the filter 70 of FIG. 9, each resonator is directly coupled to an opposing resonator. That is, resonator 72*a* is directly coupled to resonator 72*c*, and resonator 72*b* is directly coupled to resonator 72*d*. By introducing this coupling between opposing elements, additional zeros are formed in the transfer function of the filter 70 at the edges of the stopband.

To form the required zeros in the transfer function, it is important that coupling between the aforementioned pairs be optimized while coupling between other pairs, such as between resonator 72*a* and resonator 72*b*, or between resonator 72*c* and resonator 72*d*, be minimized. In conceiving of the present invention, it was appreciated that anisotropic coupling characteristics could be achieved by properly choosing the type and arrangement of the elements. For example, it was found that decreased coupling could be achieved between a first and a second pinched end resonator by arranging the resonators so that the side having the pinched end on the first resonator faces the same side on the second resonator. For example, with reference to FIG. 9, side 80*a* of resonator 72*a* faces side 80*c* of resonator 72*c* and side 80*b* of resonator 72*b* faces side 80*d* of resonator 72*d*.

In addition to the above, it was appreciated that coupling could be reduced between two resonators by using a meandering line on each of the coupled sides between the resonators. For example, with reference to FIG. 9, resonators 72*a* and 72*b* both include meandering lines 82*a* and 82*b*, respectively, on the sides facing one another. The same applies to resonators 72*c* and 72*d* in that the resonators include meandering lines 82*c* and 82*d*. By using a meandering line, the effective distance between the elements is increased, thereby decreasing coupling between the elements, while the actual distance between the elements remains the same. In this way, the overall dimensions of the filter 70 can be reduced while still achieving a desired low coupling between certain elements.

To achieve a desired filter response, a predetermined electrical distance must be provided on through line 78 between the coupling points of the four resonators 72*a*–72*d*. To reduce the overall dimensions of the filter 70, a meandering through line 78 has been implemented. By having the through line 78 follow a winding path, rather than a straight one, the elements 72*a*–72*d* can be spaced closer together while still maintaining the desired electrical length between coupling points. This reduces the size of the filter.

By introducing coupling between the resonator elements, a quasi-elliptic filter response is achieved rather than a Chebyshev or Butterworth filter response. Because a quasi-elliptic filter response, having very sharp cutoffs, is achieved, the number of resonators required for sharp stop-band cutoff characteristics is reduced. Reducing the number of resonators naturally reduces the size of the filter.

It should be appreciated that the metallization structures disclosed herein can be produced on a substrate by well known deposition and masking techniques. In addition, sheet metal stamping and other processes can be used to create slab line or other airloaded transmission structures.

Although the present invention has been described in conjunction with its preferred embodiments, it is to be understood that modifications and variations may be resorted to without departing from the spirit and scope of the invention as those skilled in the art readily understand. For example, the techniques and structures described above are not limited to use with half-wavelength resonators and can also be used with other resonator types, such as quarter-wavelength resonators. Such modifications and variations are considered to be within the purview and scope of the invention and the appended claims.

What is claimed is:

1. A planar filter for radio frequency energy, comprising:

a plurality of resonating elements separated from a ground structure by a dielectric layer, the plurality of resonating elements including input and output resonating elements and said plurality of resonating elements respectively are arranged in an approximately linear fashion and each of said plurality of resonating elements respectively includes a first longitudinal center axis respectively that is substantially normal to a direction of flow of radio frequency energy through the filter, said respective first longitudinal center axis being substantially centered between farthest edges of said corresponding resonating element on either side of said respective first longitudinal center axis, each of said plurality of resonating elements respectively being asymmetrical about the corresponding first longitudinal center axis, wherein each pair of adjacent resonating elements in said plurality of resonating elements has a corresponding second longitudinal center axis located therebetween, the second longitudinal center axis being substantially normal to a direction of flow of radio frequency energy through the filter, wherein each pair of adjacent resonating elements is asymmetrical about a corresponding second longitudinal center axis, and wherein the number of pairs of adjacent resonating elements is odd; and an input, for radio frequency energy, in communication with the input resonating element and an output, for the radio frequency energy, in communication with the output resonating element, wherein at least one of the input and output has a first portion spaced from a corresponding one of the input and output resonating elements for distributively coupling a first component of the radio frequency energy between the first portion and the corresponding one of the input and output resonating elements and a second portion physically connected to the corresponding one of the input and output resonating elements for tap coupling a second component of the radio frequency energy between the second portion and the corresponding one of the input and output resonating elements such that the first component of the radio frequency energy substantially excludes the second component of the radio frequency energy.

2. A planar filter for radio frequency energy, comprising:

a plurality of resonating elements separated from a ground structure by a dielectric layer, said plurality of resonating elements including an input resonating element and an output resonating element and said plurality of resonating elements respectively are arranged in an approximately linear fashion and each of said plurality of said resonating elements respectively includes a first longitudinal center axis respectively that is substantially normal to a direction of flow of radio frequency energy through the filter, said respective first longitudinal center axis being substantially centered between farthest edges of said corresponding resonating element on either side of said respective first longitudinal center axis, each of said plurality of resonating elements respectively being symmetrical about the corresponding first longitudinal center axis, wherein each pair of adjacent resonating elements in said plurality of resonating elements has a corresponding second longitudinal center axis located therebetween, the second longitudinal center axis being substantially normal to a direction of flow of radio frequency energy through the filter, wherein each pair of adjacent resonating elements is asymmetrical about a corresponding second longitudinal center axis, and wherein each of the plurality of resonating elements includes a corresponding pinched end;

an input for coupling radio frequency energy from an exterior environment to said input element; and an output for coupling radio frequency energy from said output resonating element to said exterior environment;

wherein one of said input and said output includes a first conductive portion that is physically connected to a corresponding one of said input resonating element and said output resonating element for conductively transferring radio frequency energy therewith and the other of said input and said output includes a second conductive portion that is spaced from a corresponding one of said input resonating element and said output resonating element for radiatively transferring radio frequency energy therewith.

3. The planar filter of claim 2, wherein each of the resonating elements is comprised of a respective single conductive strip having a first end portion and a second end portion, wherein said first end portion is proximate to and parallel with said second end portion to provide a distributed capacitance there between.

4. The planar filter of claim 3, wherein:

said other of said input and said output also includes a third conductive portion that is physically connected to a corresponding one of said input resonating element and said output resonating element for conductively transferring radio frequency energy therewith.

5. A planar bandpass filter for radio frequency energy, comprising:

a plurality of resonating elements arranged in an approximately linear fashion, wherein each of said plurality of resonating elements respectively includes a first longitudinal center axis that is substantially normal to a direction of flow of radio frequency energy through the filter, said first longitudinal center axis being respectively substantially centered between farthest edges of a corresponding resonating element on either side of said respective first longitudinal center axis, each of said plurality of resonating elements being asymmetrical about a corresponding first longitudinal center axis, wherein each pair of adjacent resonating elements has a corresponding second longitudinal center axis located therebetween, the second longitudinal center axis respectively being substantially normal to the direction of flow of radio frequency energy through the filter, wherein each pair of adjacent resonating elements is asymmetrical about the corresponding second longitudinal center axis, and wherein the number of pairs of adjacent resonating elements is odd.

6. The planar filter of claim 5, wherein at least one resonating element in the plurality of resonating elements has a corresponding plurality of legs and folds, wherein a corresponding first leg, a corresponding second leg, and a corresponding third leg are substantially parallel to one another, the corresponding first and second legs defining an outer boundary of the corresponding resonating element and the corresponding third leg being located between an outer edge of the corresponding first leg and an outer edge of the corresponding second leg, and wherein the corresponding first and second legs are connected by a corresponding first fold and the corresponding second and third legs by a corresponding second fold, the corresponding second fold being different from the corresponding first fold.

7. The planar filter of claim 5, wherein at least one resonating element in the plurality of resonating elements includes a superconducting material.

8. The planar filter of claim 7, wherein:

said superconducting material is disposed in a continuous line having a corresponding third portion, a corresponding fourth portion, and a corresponding total length, wherein said corresponding third portion is spaced apart from and approximately parallel to said corresponding fourth portion to provide a distributed capacitance between said corresponding third portion and said corresponding fourth portion.

9. The planar filter of claim 8, wherein the length of said corresponding third portion that is adjacent to said corresponding fourth portion is approximately 10% of the corresponding total length.

10. The planar filter of claim 8, wherein the distance between the corresponding third portion and the corresponding fourth portion of the line is approximately 5 mils.

11. The planar filter of claim 8, wherein the distributed capacitance is approximately 2 picofarads.

12. The planar filter of claim 8, wherein the planar filter has an unloaded Q of at least about 25,000.

13. A planar filter for radio frequency energy, comprising:

a first resonating element having a plurality of legs and folds, wherein a first leg, a second leg, and a third leg are substantially parallel to one another, the first and second legs defining an outer boundary of the first resonating element and the third leg being located between an outer edge of the first leg and an outer edge of the second leg, wherein the first and second legs are connected by a first fold and the second and third legs by a second fold, the second fold being different from the first fold, wherein the first resonating element is asymmetrical about a first longitudinal center axis that is substantially parallel to said first, second and third legs.

14. The planar filter of claim 13, further comprising an input and output to the filter, the resonating element having a latitudinal center axis that is substantially parallel to a direction of flow of radio frequency energy through the filter, the input and output being located on opposing sides of the latitudinal center axis.

15. The planar filter of claim 13, further comprising:

a fourth leg, located between the first and second legs, that is connected to said third leg by a third fold.

16. The planar filter of claim 15, wherein:

said fourth leg is substantially parallel to said first, second, and third leg.

17. The planar filter of claim 15, wherein:

said fourth leg is spaced from said second leg so as to create a distributed capacitance therebetween.

18. The planar filter of claim 13, wherein:

said first leg and said third leg are part of an interdigital coupling structure.

19. The planar filter of claim 13, wherein:

said second fold is narrower than said first fold.

20. The planar filter of claim 13, wherein:

said third leg is spaced from said first leg so as to create a distributed capacitance therebetween.

21. The planar filter of claim 13, further comprising a second resonating element spaced from and coupled to the first resonating element and having first, second, and third legs and first and second folds substantially the same as those of the first resonating element, wherein the first resonating element and the second resonating element are asymmetrical about a second longitudinal center axis located midway between an outer boundary of the first resonating element and an outer boundary of the second resonating element.

22. The planar filter of claim 13, wherein the first and second folds are located at opposing ends of the first resonating element.

23. The planar filter of claim 13, wherein the filter has a Chebyshev-type response.

24. A planar bandstop filter for radio frequency energy, comprising:

a transmission line section having an input and an output; and a plurality of resonating elements coupled to said transmission line section at predetermined intervals along a length of said transmission line section, each of said plurality of resonating elements having a respective coupling point along said transmission line section that represents an area of strongest coupling between said corresponding resonator element and said transmission line section, wherein said plurality of resonating elements includes a first resonating element having a first coupling point, a second resonating element having a second coupling point, and a third resonating element having a third coupling point, wherein a radio frequency signal propagating along said transmission line section from said input to said output first passes said first coupling point, then passes said second coupling point, and later passes said third coupling point;

wherein each of said first and third resonating elements includes a pinched end and the respective pinched ends are in an opposing relationship and wherein each of said first and second resonating elements includes a meandering line and the respective meandering lines of said first and second resonating elements are in an opposing relationship, whereby a coupling between said first resonating element and said third resonating element is stronger than a coupling between said first resonating element and said second resonating element.

25. The filter of claim 24, wherein:

said first resonating element is physically closer to said second resonating element than it is to said third resonating element.

26. The filter of claim 24, wherein:

said first and third resonating elements have an interresonator coupling coefficient therebetween that is dependent on a bandwidth of said filter.

27. The filter of claim 24, wherein:

said transmission line section is meandered to reduce the overall dimensions of said filter.

28. The filter of claim 24, wherein:

said first, second, and third resonating elements are each pinched end resonating elements, each pinched end resonating element being comprised of a respective single conductive strip having a first end portion and a second end portion, wherein said first end portion is proximate to and parallel with said second end portion to provide a respective distributed capacitance therebetween, each of said pinched end resonating elements having a respective first side including both said first end portion and said second end portion of said corresponding conductive strip.

29. The filter of claim 28, wherein:

said transmission line section includes at least one 180 degree bend so that said first resonating element is directly opposed to said third resonating element.

30. The filter of claim 29, wherein:

said first side of said first resonating element faces said first side of said third resonating element.

31. The filter of claim 30, wherein:

said first resonating element includes a second side having a meander line portion, wherein said second side of said first resonating element faces said second resonating element.

32. The filter of claim 31, wherein:

said second resonating element includes a second side having a meander line portion, wherein said second side of said second resonating element faces said second side of said first resonating element.

33. The filter of claim 29, further comprising:

a fourth resonating element having a fourth coupling point located between said second and third coupling point on said transmission line section, said fourth resonating element being a pinched end resonating element and directly opposing said second resonating element, wherein a first side of said fourth resonating element faces the first side of said second resonating element.

34. The filter of claim 33, wherein:

said transmission line section includes a first meander portion between said first and second coupling points.

35. The filter of claim 34, wherein:

said transmission line section includes a second meander portion between said third and fourth coupling points.

36. The filter of claim 35, wherein:

said transmission line section includes a third meander portion between said second and fourth coupling points, wherein said third meander portion includes said at least one 180 degree bend.

* * * * *